US005433309A

United States Patent [19]

Yellop et al.

[11] Patent Number: 5,433,309

[45] Date of Patent: Jul. 18, 1995

[54] COIN MECHANISM

[75] Inventors: Andrew M. Yellop, Surrey; Charles E. Rees, Berkshire, both of United Kingdom

[73] Assignee: Mars Incorporated, McLean, Va.

[21] Appl. No.: 988,106

[22] PCT Filed: Jul. 18, 1991

[86] PCT No.: PCT/GB91/01205

§ 371 Date: Feb. 8, 1993

§ 102(e) Date: Feb. 8, 1993

[87] PCT Pub. No.: WO92/02904

PCT Pub. Date: Feb. 20, 1992

[30] Foreign Application Priority Data

Aug. 10, 1990 [GB] United Kingdom ..... 9017577

[51] Int. Cl.[6] ..... G07D 3/14

[52] U.S. Cl. ..... 194/200; 453/3

[58] Field of Search ..... 194/200, 201, 202; 453/3, 4

[56] References Cited

U.S. PATENT DOCUMENTS 3,916,922 11/1975 Prunn ..... 453/3

FOREIGN PATENT DOCUMENTS 511435 11/1978 Australia .
0134686 3/1985 European Pat. Off. .
2355418 1/1978 France .
3430072 2/1986 Germany .
3512579 10/1986 Germany .
3802601 8/1989 Germany ..... 194/202
1-276293 11/1989 Japan ..... 194/200
610240 10/1948 United Kingdom .
2137793 10/1984 United Kingdom .

OTHER PUBLICATIONS

*Special Designs for Electronic Circuits*, p. 148 (date and author unknown).

*Primary Examiner*—F. J. Bartuska
*Attorney, Agent, or Firm*—Davis Hoxie Faithfull & Hapgood

[57] ABSTRACT

A coin mechanism comprising a testing mechanism for testing coins as to their acceptability and denomination, an accept/reject gate which is normally in a reject position but is electrically powered to an accept position in response to the testing mechanism determining that a coin is acceptable, and an electrically-actuated coin separator adapted to receive the acceptable coins from the accept/reject gate and direct them selectively towards different destinations in dependence upon their denominations as determined by the testing mechanism, characterised by mechanism adapted to provide power for electrical actuation of the coin separator, following failure of electrical power for the accept/reject gate, for a period sufficient to allow the coin separator to complete the direction towards its correct destination of a coin which has passed the accept/reject gate in its accept position. This avoids a coin being directed by the separator to the wrong destination if a power failure occurs after a coin has been committed to the separator but before the separator has directed it to the correct destination, thus avoiding coin jams.

22 Claims, 1 Drawing Sheet

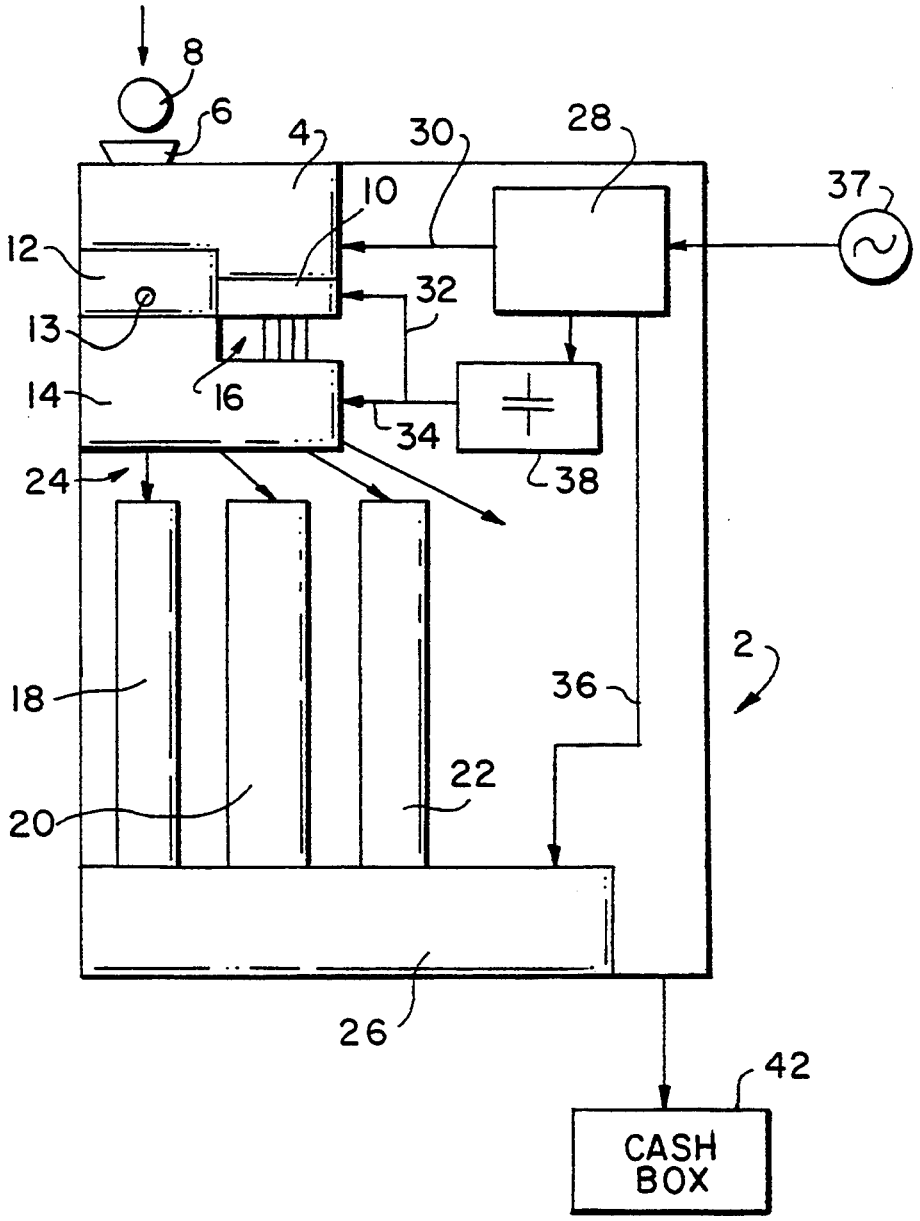
8
6
4
30
28
37
10
12
32
13
14
16
34
38
24
2
18
36
22
20
26
42
CASH BOX

COIN MECHANISM

BACKGROUND OF THE INVENTION

Field of the Invention

This invention relates to coin mechanisms.

The term "coin" when used herein includes genuine coins, tokens, counterfeit coins and any other objects which may be inserted into a coin mechanism in an attempt to obtain any kind of goods or services.

The invention particularly relates to coin mechanisms which test coins as to their acceptability and, if acceptable, indicate their denomination, which have an accept/reject gate which is normally in a reject position but is electrically powered to an accept position when the testing means finds a coin acceptable, and have an electrically-actuated coin separator adapted to receive the acceptable coins from the accept/reject gate and direct them selectively towards different destinations in dependence upon their denominations. When a coin does not meet the criteria for acceptability, power is not applied to the accept/reject gate which thus remains in its reject position and this directs the coin onto a path which delivers it back for retrieval by the customer.

The destinations for accepted coins typically include a plurality of coin stores for specific coin denominations, these usually being in the form of coin tubes, which may have different diameters depending upon the particular coin denomination each is intended to contain, and which are adapted to hold the coins to them in a vertical stack face-to-face. A coin dispensing arrangement is provided for dispensing appropriate combinations of coins from the bottoms of the stacks for the purpose of giving change or providing prizes. Additionally, there is usually a cashbox to which are directed coins which it is not intended to dispense either as change or as prizes, and also coins which might normally be directed to specific coin stores but which are accepted when the particular coin store in question is already full.

Coin mechanisms of this general type are well known and widely sold.

A problem that can occur is coin jams resulting from an acceptable coin of a particular denomination inadvertently being directed to a destination which is not intended for coins of that denomination. For example, this may happen if a coin of a particular diameter is actually delivered to a coin tube intended for coins of a smaller diameter, when the jam may occur within or at the top of the tube itself, or it may occur if a coin of a given thickness is delivered into a tube intended for coins of a greater thickness, in which case the jam may occur when the dispenser is operated in an attempt to dispense the coin which is thinner than those it is designed to dispense.

Some coin separators are of a passive type, that is to say they contain mechanical, unpowered, features which can cause arriving coins to be directed onto different paths by mechanical interaction with dimensional features of the coins such as their diameters and thicknesses. Other types of separators, often referred to as active separators, include movable elements which can be electrically actuated to adopt two or more different positions, the actuation being carried out in response to a signal or signals indicative of the denomination of the coin as determined by the testing means, and the position of the movable element, or the combined positions of several such movable elements, cause the arriving coin to be directed onto a path appropriate for a coin of that particular denomination at that time. It is also possible for coin separators to be partly passive but also partly active and for the purpose of the present specification the term "electrically-actuated coin separator" includes any coin separator which relies, if only even in part, upon electrical actuation for its correct operation.

It has been found that coin jams downstream of the coin separator occur more often when electrically-actuated separators are used than when passive separators are used. The reasons are not always completely clear nor easy to determine.

SUMMARY OF THE INVENTION

An object of the present invention is to reduce the extent to which power failures, whether brief interruptions or long ones, can cause mis-direction of coins by an electrically-actuated coin separator, and hence reduce the incidence of coin jams.

In accordance with the invention, means is provided which is adapted to provide power for electrical actuation of the coin separator, following failure of electrical power for the accept/reject gate, for a period sufficient to allow the coin separator to complete the direction towards an appropriate destination of a coin which has passed the accept/reject gate in its accept position.

Once a coin has passed the accept/reject gate, having been found acceptable, an immediate failure of the power for the actuation of the separator would result in the separator either not being actuated to the correct condition for the particular denomination of that coin or, if it had already been so actuated, in being prematurely de-actuated. In either event, the coin would be directed to the wrong destination unless the coin had already travelled sufficiently far through the separator to have become committed to the correct destination.

This particular possible cause of coin jams is eliminated by the present invention since for a limited, but sufficient, period the power needed to maintain the correct actuated condition, or to initiate such actuation and also maintain it, is provided for sufficiently long for correct direction of the coin to be achieved. It is not, of course, necessary for power to be provided for long enough for the coin to actually arrive at its destination, so long as it is provided for long enough to be certain that the coin is committed to arrival at that destination. For the present purpose, a power failure occurring immediately before a coin reaches the accept/reject gate is unimportant because the resulting non-powering of the accept reject gate will cause the coin to be rejected, even though preferably it might have been accepted, but there will be no internal mis-routing of the coin.

BRIEF DESCRIPTION OF THE DRAWING

In order that the invention may be more clearly understood an embodiment thereof is shown in the accompanying diagrammatic drawing.

DETAILED DESCRIPTION OF THE INVENTION

In the drawing, a coin mechanism 2 comprises coin testing means 4 having an inlet 6 for coins 8 to be tested. A microprocessor 10 is schematically illustrated, which normally will form part of the testing means. Microprocessor 10 compares measurements which are taken on the coin by the testing means with reference values appropriate to various different denominations of acceptable coins. When the comparison indicates that the coin inserted is acceptable the microprocessor provides a signal which causes power application to the actuator, normally a solenoid, of an accept/reject gate 12 which moves to a position such that the coin is delivered into a coin separator 14. If the coin is not found acceptable, the actuator of the accept/reject gate is not powered and so remains in a reject position such that the coin takes a path (not shown) back to the exterior of the mechanism where the customer can retrieve it.

When a coin is acceptable, the microprocessor 10 also provides a signal, on output lines 16, indicative of the denomination of the coin. Coin tubes 18, 20 and 22 are provided each of which is intended in normal operation to receive accepted coins of a particular respective denomination.

The coin separator 14 is actuated in response to the coin denomination as indicated by the output signal on lines 16, so as to direct the coin, in dependence upon its denomination, towards the correct one of the tubes 18, 20 and 22 on one of the paths generally indicated by the arrows 24, if necessary via a suitable manifold. One of the paths out of the separator may lead to a cashbox 42 for receiving any denominations that are not needed for dispensing, and any accepted coins which would normally go to a coin tube but which are diverted to the cashbox if the respective coin tube is already full. Actuation of the separator may consist of energising the appropriate ones of a plurality of solenoids which control the configuration of a set of gates, or the appropriate positioning of a motor which in turn positions a coin guide to direct a coin through the appropriate one of several outlets of the separator.

When there is a requirement for change to be given, or for a prize to be paid out, a dispensing unit 26 is operated in well-known manner to dispense to the customer the appropriate coin or combination of coins from the bottoms of the coin stacks in tubes 18, 20 and 22.

Power for operation of the mechanism is provided from a power supply circuit 28 which delivers appropriate voltages to the various sections of the mechanism on lines 30, 32, 34 and 36, the power supply circuit 28 in turn being powered from the mains 37 or possibly, in some applications, a battery or other source of power.

The principles of operation and construction of the mechanism as just described are all known to the man skilled in the art and therefore further detailed description is not required.

As previously explained, if the power on line 34, for actuating the coin separator 14, were to fail at any time after a coin is committed to enter the separator from the accept/reject gate but before that coin has been directed by the separator towards the correct tube 18, 20 or 22, it would be possible for the coin to arrive in the wrong tube and hence cause a jam.

This is avoided by providing a back-up circuit 38 which continues to provide power on line 34 for actuating, or maintaining the existing actuation of, the coin separator for a limited period after a failure of the power outputs from the power supply 28, which might arise from internal reasons or from failure of the mains 37. Additionally, circuit 38 continues to supply power on line 32 to the microprocessor 10 so that the coin denomination signals on lines 16 are maintained hence ensuring that the separator actuator or actuators are correctly energised, as well as ensuring that power is available for their energisation.

The circuit 38 may be a simple capacitative circuit, maintained in a charged state from the power supply circuit 28, or it may include a small rechargeable battery also maintained in a charged state by power supply circuit 28. Since the time required for an efficient separator to complete the correct routing of a coin will normally be substantially less than one second, perhaps 150 milliseconds or less, a battery would not in most cases be required.

If for any reason it were desirable, back-up power for the separator could be provided for half a second, one second, or even 5 seconds.

A refinement of the invention will now be described. Some separators are such that they will take different periods of time to direct a coin towards respective different ones of their outlets. To operate the invention as described above, back-up power would have to be available for a period of time equal to the time it takes for a coin to move from the most upstream position at which a coin can become committed to take the accept route past the accept/reject gate to the position at which its direction by the separator has been completed on the longest (in terms of time) route through the separator. In most coin acceptance and separation arrangements, it will be possible to define a point between the point of commitment to the accept route and the point of entry into the separator, such that if power failure occurs when the coin is upstream of that intermediate point, there is still time to change the actuation of the separator so as to direct the coin towards a different destination from its normal one. Furthermore, it can be arranged that the shortest (in time) route through the separator is the one that leads to the cashbox and that it is this route which is adopted as the alternative or preferred route when power failure occurs when a coin is at or upstream of the intermediate point just referred to. The cashbox route is appropriate for all denominations of coins in the sense that delivery of any denomination to the cashbox does not cause a problem, though of course it is not the optimum route for denominations stored in coin tubes. Then, the period for which back-up power must be available is either the time it takes for a coin to move from the intermediate point to a point where its direction by the separator has been completed on the longest (in terms of time) path through the separator, or the time it takes for a coin to move from the point of commitment to the accept route to a point where its direction by the separator has been completed on the shortest (in terms of time) cashbox path, whichever is the longer. Both of these time periods will be shorter than the period of back-up power required when operating the invention as initially described. For a given set-up, the length of the longer period, and hence the amount of back-up power to be provided, can be determined empirically.

To effect this refinement in the embodiment described, a coin detector 13 is positioned such that it can detect a coin after it has been committed to, and is moving through, the accept path. The "intermediate point" referred to above may be defined by the leading edge of the signal from sensor 13 generated as the coin enters that detector, or the trailing edge of the signal, generated as the coin leaves the detector. By supplying the output of detector 13 to the microprocessor 10, and appropriately programming the microprocessor 10, the microprocessor 10 can determine whether power failure occurs early enough for the separator to be actuated to direct the coin to the cashbox, or so late that the normal actuation of the separator for that particular coin should be maintained.

It is common for a coin detector to be located just after the point of commitment to the accept path from the accept/reject gate, primarily for the purpose of indicating that a coin has become irretrievable and therefore credit in respect of that coin may be given. Such a detector may be used as detector 13, so that no additional coin detector need be provided.

What is claimed is:

1. A coin mechanism comprising testing means for testing coins as to their acceptability and denomination, an accept/reject gate which is normally in a reject position but is electrically powered to an accept position in response to the testing means determining that a coin is acceptable, an electrically-actuated coin separator adapted to receive the acceptable coins from the accept-/reject gate and direct them selectively towards different destinations in dependence upon their denominations as determined by the testing means, means adapted to provide power for electrical actuation of the coin separator, following failure of electrical power for the accept/reject gate, for a period sufficient to allow the coin separator to complete the direction towards an appropriate destination of a coin which has passed the accept/reject gate in its accept positions, means adapted to determine whether a coin is upstream or downstream of a particular position between the accept/reject gate and the coin separator when a power failure occurs, and means adapted to actuate the separator to direct the coin towards a preferred destination when said determination is that the coin was upstream of said particular position.

2. A coin mechanism as claimed in claim 1, wherein said means adapted to determine the coin position includes a coin detector, the output signal of which is utilized in authorizing credit.

3. A coin mechanism as claimed in claim 1, wherein said means adapted to provide power have the capacity to do so only for a limited period.

4. A coin mechanism as claimed in claim 3, wherein said limited period does not exceed about five

5. A coin mechanism as claimed in claim 1, in which said means adapted to provide power comprises a capacitive circuit.

6. A coin mechanism as claimed in claim 1, in which said means adapted to provide power comprises a rechargeable battery.

7. A coin mechanism as claimed in claim 1, wherein said means adapted to supply power, supplies power to the microprocessor.

8. A coin mechanism comprising:

a coin separator;

a first power supply circuit operatively connected to the coin separator;

a capacitive circuit operatively connected to the coin separator, wherein if the first power supply circuit fails to supply power to the coin separator, the capacitive circuit supplies power to the coin separator.

9. The coin mechanism of claim 8, wherein the capacitive circuit provides power to the coin separator for a limited period.

10. The coin mechanism of claim 9, wherein the limited period does not exceed about 5 seconds.

11. The coin mechanism of claim 8, further comprising an accept path, an accept/reject gate and a detector, the accept/reject gate, detector and separator being located along the accept path, wherein the detector determines if a coin has passed the detector when the first power supply fails to supply power to the coin separator, and the coin separator directs a coin towards a preferred destination if the coin has passed the detector.

12. The coin mechanism of claim 11, wherein the preferred destination is a cashbox.

13. The coin mechanism of claim 12, wherein the coin detector generates an output signal which is used in authorizing credit.

14. The coin mechanism of claim 8, further comprising a microprocessor, wherein the capacitive circuit supplies power to the microprocessor if the first power supply fails.

15. A method of operating a coin mechanism comprising:

energizing a coin separator by power from a first supply; and energizing the coin separator by power from a capacitive circuit if the first supply fails.

16. The method of claim 15, further comprising:

determining if a coin is upstream or downstream of a particular position when the first power supply fails; and selectively directing the coin to a particular location if the coin is upstream of that position.

17. The method of claim 16, wherein the coin is selectively directed to a cashbox.

18. The method of claim 15, further comprising energizing a microprocessor by power from the first supply and energizing the microprocessor by the capacitive circuit if the first power supply fails.

19. The method of claim 15, wherein the coin separator is energized by power from the second power supply, for a limited time period.

20. The method of claim 19, wherein the limited time period is less than about five seconds.

21. The method of claim 19, wherein the limited time period is about 150 milliseconds.

22. A method of operating a coin mechanism comprising:

energizing a coin separator by power from a first power supply;

energizing the coin separator by power from a second power supply if the first power supply fails;

determining if a coin is upstream or downstream of a particular position when the first power supply fails; and selectively directing the coin to a particular location if the coin is upstream of that position.

* * * * *

UNITED STATES PATENT AND TRADEMARK OFFICE

CERTIFICATE OF CORRECTION

PATENT NO. : 5,433,309

DATED : July 18, 1995

INVENTOR(S) : Andrew M. Yellop et al.

It is certified that error appears in the above-identified patent and that said Letters Patent is hereby corrected as shown below:

In the Abstract:

Line 11, cancel "mechanism" and substitute --a circuit--.

In the Claims:

Col. 5, line 28, (claim 1) cancel "positions" and substitute --position--.

Signed and Sealed this

Fifteenth Day of July, 1997

Bruce Lehman

*Attest:*

BRUCE LEHMAN

*Attesting Officer*

*Commissioner of Patents and Trademarks*